United States Patent [19]

Hinterholzer

[11] 3,953,043

[45] Apr. 27, 1976

[54] DEVICE FOR PREVENTING A CROSSING OF SKIS DURING SKIING

[76] Inventor: Hans Hinterholzer, Nr. 36, Saalbach, Austria

[22] Filed: Oct. 15, 1974

[21] Appl. No.: 515,062

[30] Foreign Application Priority Data

Oct. 19, 1973 Austria ..... 8900/73

[52] U.S. Cl. ..... 280/11.37 E

[51] Int. Cl.[2] ..... A63C 11/00

[58] Field of Search ..... 280/11.37 E, 11.37 J, 280/11.37 R, 11.13 T, 11.13 B, 11.13 Z

[56] References Cited

UNITED STATES PATENTS

| | | | |
|---|---|---|---|
| 3,148,891 | 9/1964 | Heuvel | 280/11.37 E |
| 3,295,860 | 1/1967 | Von Hoven | 280/11.37 E |
| 3,601,421 | 8/1971 | Ris | 280/11.37 E |
| 3,863,943 | 2/1975 | Giannotti | 280/11.37 E |

*Primary Examiner*—M. H. Wood, Jr.
*Assistant Examiner*—David M. Mitchell
*Attorney, Agent, or Firm*—Fleit & Jacobson

[57] ABSTRACT

A device for preventing the overcrossing of skis worn by a skier which includes a locking member pivotally mounted on a base plate secured to a ski, the locking member being yieldingly urged in one direction into an upstanding position against a stop on the base plate by a spring to form a barrier against overcrossing by an adjacent ski, the locking member being pivotally movable in the opposite direction against the force of the spring to release an overcrossed ski and disengageable from the stop for pivotal movement in the one direction into an overlying, storage position on the ski.

10 Claims, 3 Drawing Figures

DEVICE FOR PREVENTING A CROSSING OF SKIS DURING SKIING

Figure 1:
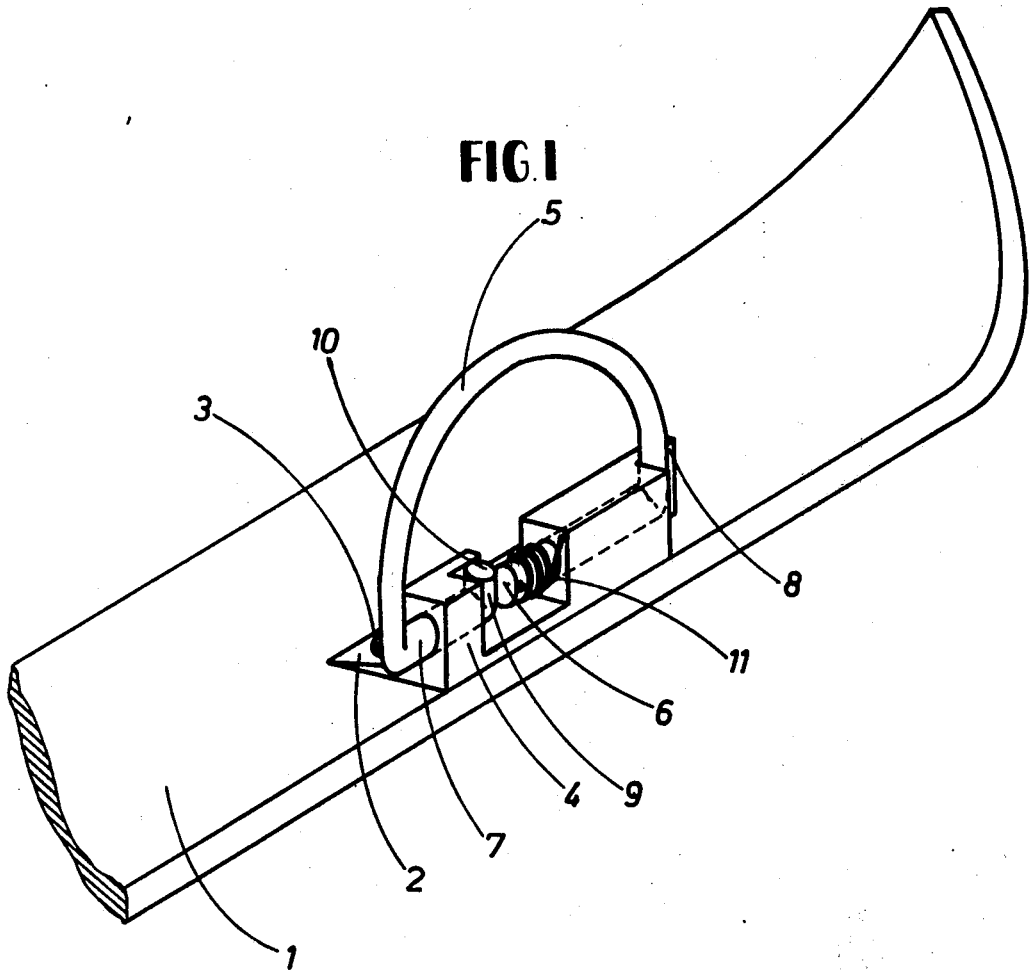

This invention relates to a device for preventing a crossing of skis during skiing, comprising a locking member, which is secured to the forward portion of each ski and protrudes upwardly from the surface of the ski.

A device of that kind has been disclosed, e.g., in the French Pat. No. 2,137,348 and comprises a U-shaped locking member, which is connected to a base plate and on the side, which is opposite to the other ski, extends obliquely relative to the surface of the ski. In spite of this inclination a skier using the known device may lift one ski over the locking member, which is screwed to the other ski so that the latter locking member prevents the return of the overcrossing ski and the skier inevitably falls. Such a fall may be highly dangerous particularly when the skiers are crossed.

It is an object of the present invention to provide a device, which prevents a crossing of skis and which permits a ski that has been moved to an overcrossing position to be returned to its normal position without substantial obstruction by the device.

In a device of the kind described first hereinbefore, this object is accomplished in that the locking member is pivotally movable against spring force from an upright position toward the other ski to a position, in which the locking member is parallel to the surface of the ski. The provision of the device according to the invention ensures that the locking member remains in its upright locking position in the direction of an overcrossing movement of a ski but is pivotally movable when a ski is being returned from an overcrossing position so that the skier himself can return the overcrossing ski substantially without an obstruction by the locking member.

In a simple embodiment of the invention, the locking member is pivotally mounted on a base plate, which is adapted to be screw-connected to the ski, and is pivotally movable on an axis, which is parallel to the ski, and a spring is provided, which tends to hold the locking member in an upright position in engagement with a stop of the base plate. The spring may be very soft so that it will present only a small resistance to the return of an overcrossing ski when this is required.

The base plate may rise in the shape of a wedge from the surface of the ski to the hinge provided on the side of the base plate so that neither the base plate nor the hinge have steps, which could interengage with a ski as it is returned from an overcrossing position.

The locking member is suitably held in an upright position by a helical torsion spring or by a hairpinlike spring, the free legs, of which bear respectively on the base plate and on the locking member or its pivot.

The locking member may be U-shaped and have leg ends, which are angled toward each other and mounted in bearing bores of the base plate. The U-shaped locking member may bear in its upright position against a stop of the base plate so that the locking member can be swung toward the surface of the ski only in the direction toward the other ski. The ends of the U-shaped member, which are mounted in bearing bores may extend from the bearing bore and be angled so that these angled ends bear on a stop.

In another embodiment of the invention, the locking member is pin-shaped and has a right-angled portion, which is mounted in a bearing bore of the base plate. The pin-shaped locking member may be axially slidable in its bearing bore so that the locking member is adapted to disengage the stop formed by the base plate and can be swung in the locking direction to a position, in which it is parallel to and in contact with the surface of the ski. In this embodiment the locking member does not give rise to difficulties in the transportation and storage of the ski.

To prevent injury to a skier by the upright locking member in case of a fall, the locking member may be compressible and be adapted to buckle owing to the provision of an elastic element.

Figure 2:
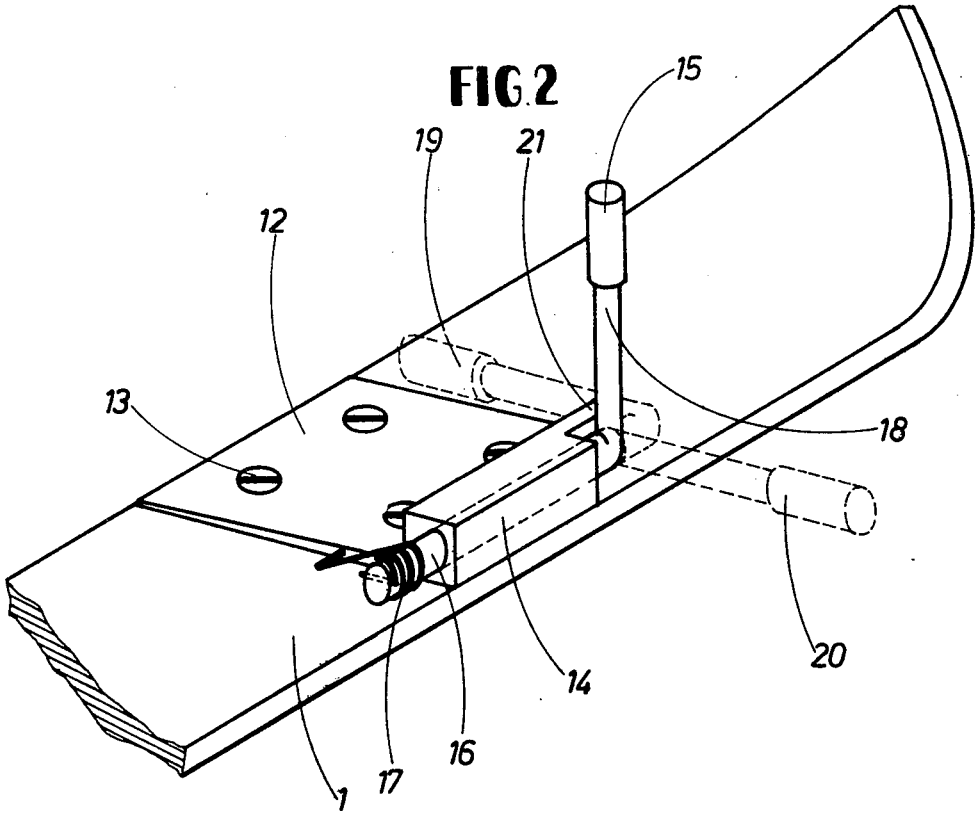
Figure 3:
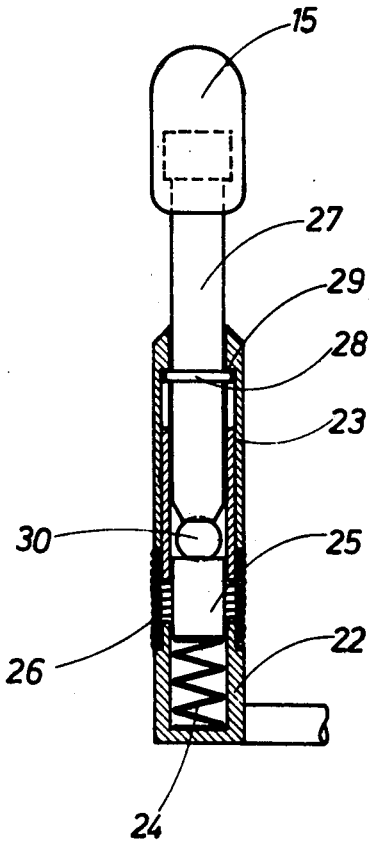

Embodiments of the invention will be explained more fully and by way of example hereinafter with reference to the drawing, in which FIG. 1 is a perspective view showing a U-shaped locking member and a base plate screw-connected to a ski, FIG. 2 is a perspective view showing a pin-shaped locking member and a base plate, and FIG. 3 is a sectional view showing a locking pin, which is adapted to be compressed and to buckle.

The device shown in FIG. 1 comprises a base plate 2, which is secured to the ski 1 with screws 3. On its side, which faces the other ski, the base plate 2 has a portion 4, which is increased in diameter and provided with a bearing bore. The locking member consists of a U-shaped member 5, which has end portions 6, 7 that are angled toward each other and mounted in the bearing bores. As is shown on the right in FIG. 1, the U-shaped member 5 may bear against a stop 8. As is shown on the left in FIG. 1, the angled portion of the U-shaped member 5 may be inserted into the bearing bore, and beyond the bearing bore may be angled to form an angled portion 9, which may bear on the stop 10 of the base plate 2. The U-shaped member 5 is forced against the stop 8 by a spring 11, the ends of which are respectively connected to the angled portion 6 of the U-shaped member and to the base plate. In the embodiment shown on the left in FIG. 1, the angled portion 9 is held in engagement with a stop 10. When the other ski engages the U-shaped member 5, the latter prevents a movement of said ski to an overcrossing position. On the other hand, when said other ski has been lifted over the U-shaped member 5 to an overcrossing position, said ski may be pushed back over the U-shaped member to a normal position because the U-shaped member is swung down by the overcrossing ski as the same is returned.

In the embodiment shown in FIG. 2, the locking member consists of an upright pin 18, which has an angled portion 16, which is pivoted in a bearing bore extending through a bar 14, which is connected to the base plate 12. The base plate 12 is secured to the ski 1 with screws 13.

To provide a stop 21, which is engaged by the locking pin in its locking position, the bar 14 is formed with a recess. In its upright locking position, the locking pin 18 is held in engagement with the stop 21 by the spring 17, the legs of which are respectively secured to the base plate 12 and to the angled portion 16.

The angled portion 16 of the locking member 18 is axially slidable in the bearing bore so that the locking member 18 may disengage the stop 21 and is held by the spring 17 in snug engagement with the surface of the ski. The pin, which rests on the surface of the ski is indicated in dotted lines at 19. Dotted lines indicate at 20 the position to which the pin 18 is swung as an overcrossing ski is returned. An elastic cap 15 is fitted on the locking member 18 and serves to prevent injury to a skier who falls on the locking pin.

The locking pin shown in FIG. 3 is adapted to be compressed and buckled. It consists of a two-part sleeve 22, 23, which contains a piston 25, which is slidably guided in the lower part of the sleeve and biased by the spring 24. The two sleeve parts 22, 23 are connected by a closely wound helical spring 26. A pin 27 is longitudinally slidably guided in the sleeve and has a collar 28, which under the pressure of the spring 24 bears on the stop 29, which is formed on the edge of the top opening of the sleeve. A ball 30 is held in and between recesses, which are formed in the underside of the pin 27 and the top of the piston 25.

If the skier falls on the head 15 of the pin 27, the same will be depressed in the sleeve 22, 23 so that the piston 25, which is initially in a position in which it connects the sleeve parts 22, 23 is displaced into the lower part 22 of the sleeve against the pressure of the spring 24. In this position the ball 30 enters the spring 26 between the sleeve parts 22, 23 to form an articulated joint, about which the pin 27 can buckle with the upper sleeve part 23.

The base plate and the locking member may consist of metal or plastics material.

In a development of the invention, the initial stress of the spring, which holds the locking member in its upright position may be adjustable. This is particularly significant for ski racers.

The locking member may be resiliently yieldable over a small distance or a small angle also in the locking direction. Such an arrangement will facilitate the return of the ski and will damp the impact on the locking member.

What is claimed is:

1. An anti-crossing device for a ski comprising, in combination, a base plate having stop means thereon, means for mounting said base plate on the upper surface of a ski, a locking member, means for mounting said locking member on said base plate for pivotal movement along a path, means for yieldingly urging said locking member pivotally in one direction against said stop means to position said locking member in a vertically extending, operative position to provide a barrier against the overcrossing of another ski adjacent thereto, said locking member being pivotally movable against said urging means in the opposite direction by an overcrossed ski to permit uncrossing of the skis and means for disengaging said locking member from said stop means to permit said locking member to be moved pivotally by said urging means in said one direction to position said locking member in a storage position in overlying relationship with the associated ski.

2. A device in accordance with claim 1 wherein said locking member mounting means includes at least one pivot pin on said locking member and wherein said base plate is provided with a bore for rotatably accommodating said pivot pin.

3. A device in accordance with claim 2 wherein said locking member comprises a rod member and wherein said pivot pin comprises an extension of said rod member.

4. A device in accordance with claim 2 wherein said urging means comprises a torsion spring having one end connected to said base plate and the other end connected to said pivot pin.

5. A device in accordance with claim 4 wherein said torsion spring includes a helically coiled portion intermediate its ends and wherein said spring coil portion is disposed around said pivot pin.

6. A device in accordance with claim 3 wherein said locking member comprises a U-shaped rod member having free ends, each of said rod member free ends having end portions disposed in coaxial relationship to form a pair of said pivot pins and wherein said base plate is provided with a pair of coaxially aligned bores each arranged to rotatably accommodate one of said pair of pivot pins.

7. A device in accordance with claim 3 wherein said stop means comprises a shoulder on said base plate for engagement by said locking member in said operative position.

8. A device in accordance with claim 6 wherein said stop means comprises a pair of shoulders on said base plate for engagement by said locking member in said operative position.

9. A device in accordance with claim 7 wherein said means for disengaging said locking member from said stop means includes means for mounting said pivot pin in said base plate for lateral movement of said locking member relative to said path to permit said locking member to clear said stop means for movement into said storage position.

10. A device in accordance with claim 8 wherein said means for disengaging said locking member from said stop means includes means for mounting said pivot pin in said base plate bores for lateral movement of said locking member relative to said path to permit said locking member to clear said stop means for movement into said storage position.

* * * * *